United States Patent [19]

Hey et al.

[11] 4,268,407

[45] May 19, 1981

[54] CLEANING COMPOSITION

[75] Inventors: David G. Hey, Northwich; Robert W. Wheelhouse, Runcorn, both of England

[73] Assignee: Imperial Chemical Industries Limited, London, England

[21] Appl. No.: 123,074

[22] Filed: Feb. 20, 1980

[30] Foreign Application Priority Data

Mar. 2, 1979 [GB] United Kingdom ..... 7387/79

[51] Int. Cl.[3] ..... C11D 7/50; C11D 7/30; C11D 7/32; C23G 5/02

[52] U.S. Cl. ..... 252/171; 252/162; 252/172; 252/67; 252/68; 252/70; 252/DIG. 9; 252/305; 252/364; 252/579; 134/4; 134/38; 134/40

[58] Field of Search ..... 252/171, 172, 162, DIG. 9, 252/66–68, 70, 305, 364; 134/4, 38, 40

[56] References Cited

U.S. PATENT DOCUMENTS

| | | | |
|---|---|---|---|
| 3,903,009 | 9/1975 | Bauer et al. | 252/171 |
| 3,960,746 | 1/1976 | Gorski | 260/652.5 R X |
| 4,045,365 | 8/1977 | Figiel | 252/DIG. 9 X |
| 4,062,794 | 12/1977 | Figiel | 252/171 |

*Primary Examiner*—Mayer Weinblatt

*Attorney, Agent, or Firm*—Cushman, Darby & Cushman

[57] ABSTRACT

A composition for cleaning printed circuit boards contains 92 to 95 weight percent 1,1,2-trichloro-1,2,2-trifluoroethane, 5 to 7 weight percent methanol and 0.05 to 1 weight percent methyl acetate.

6 Claims, No Drawings

CLEANING COMPOSITION

This invention relates to an improved cleaning composition comprising trichlorotrifluoroethane.

It is well known that azeotropic mixtures of solvents or mixtures approximating thereto can be employed as cleaning liquids especially for the removal of contaminants from synthetic organic polymers or plastic materials. Such mixtures often comprise 1,1,2-trichloro-1,2,2-trifluoroethane as primary solvents and one or more cosolvents. The latter may be selected from a very large number of solvents including, by way of example, methylene chloride, acetonitrile, methyl acetate, methylal, acetone, 1,1-dichloroethane, trans-dichloroethylene and lower aliphatic alcohols.

Much time and effort have been expended in attempts to obtain cleaning compositions having the desired characteristics. The chosen solvent mixtures may not however be capable to cleaning the articles to a sufficient high degree. For example they may not be able to remove the modern active-resin soldering fluxes sufficiently well and the treated material may not have a high degree of surface finish.

According to the present invention we provide a cleaning composition comprising 92 to 95 weight percent of 1,1,2-trichloro-1,2,2-trifluoroethane, 5 to 7 weight percent of methanol and 0.05 to 1 weight percent of methyl acetate.

The proportions by weight of the components of the above described composition do not materially change on boiling in the liquid or vapour state.

A particularly useful composition is the azeotrope containing 93.5 weight percent 1,1,2-trichloro-1,2,2-trifluoroethane, 6.3 weight percent methanol and 0.2 weight percent methyl acetate (b.pt 39.8° C. at 763mm.Hg). Preferably both these compositions contain a small amount of nitromethane for example 0.02 to 1 weight percent, for instance 0.05 weight percent. In fact a very useful quaternary azeotrope contains 93.5 weight percent 1,1,2-trichloro-1,2,2,-trifluoroethane, 6.5 weight percent methanol, 0.03 percent methyl acetate and 0.06 weight percent nitromethane (b.pt.39.1° C. at 751mm Hg).

The components of the composition may be pure or contain small amounts of impurities associated with commercially available sources of the components.

The solvent mixtures may if desired contain a small amount of other adjuvents for example, a small amount of surface active agent.

The cleaning compositions of the present invention may be used in conventional operating techniques. Preferably the composition is employed at the boil. The contaminated article may be immersed in the cleaning composition or jetted with a spray of the composition. The article after treatment with the cleaning composition may be rinsed with the same solvent composition containing said trichlorotrifluoroethane, methanol, methyl acetate and preferably nitromethane. More preferably the azeotropes are employed in the cleaning and rinsing operations. The compositions are useful in a wide range of cleaning applications. They are also useful in the removal of water from contaminated articles.

The present invention includes within its scope a process of incorporating methanol, methyl acetate and preferably nitromethane into said 1,1,2-trichloro-1,2,2-trifluoroethane. The invention also includes within its scope a process of cleaning when using the present cleaning compositions.

The following Examples illustrate the invention. Where percentages are mentioned they are by weight.

EXAMPLE 1

Into a vacuum jacketed, twenty five plate, Oldershaw still were placed 300 mls 1,1,2-trichloro-1,2,2trifluoroethane, 50 mls methanol, and 50 mls methyl acetate.

The solvent mixture was heated at high reflux ratio for six hours. Samples were taken from the top of the column, condensed and analysed by gas liquid chromatography.

The samples were found to be a constant boiling mixture (b.pt 39.8° C. at 763 mm Hg) consisting of 93.5% 1,1,2-trichloro-1,2,2-trifluoroethane, 6.3% methanol and 0.2% methyl acetate.

EXAMPLE 2

The general procedure of Example 1 was used except that in the still there were also placed 50 mls nitromethane.

The samples taken from the top of the column were found to be a constant boiling mixture (b.pt 39.1° C. at 751 mm Hg) consisting of 93.5% 1,1,2-trichloro-1,2,2-trichloroethane, 6.5% methanol, 0.03% methyl acetate and 0.06% nitromethane.

EXAMPLE 3

A conventional, stainless steel degreasing unit was employed having a cleaning compartment and a rinsing compartment and a condenser running round the upper portion of the walls of the unit. The cleaning and rinsing compartments were both 25 cms long by 15 cms wide. Into the cleaning compartment there was placed to a depth of 10 cms a cleaning composition consisting approximately of 93.5% 1,1,2-trichloro-1,2,2-,trifluoroethane, 6.3% methanol, and 0.2% methyl acetate. Into the rinsing compartment a similar mixture was placed to a depth of 20 cms. The compositions in both compartments were heated to boiling, the vapours were condensed and the condensate fed to the rinsing compartment. There was an overflow of cleaning composition from rinsing to cleaning compartment.

Printed circuit boards (size 5 cms by 2 cms) having a substrate of epoxy resin glass mat and contaminated with a flux known as Fry's R 8 were dipped for periods of from 30 seconds to 1 minute both in the cleaning compartment and the rinsing compartment.

The treated boards were all found to be perfectly clean.

EXAMPLE 4

The apparatus and procedure of Example 3 was utilised except that the cleaning composition consisted of 93.5% 1,1,2-trichloro-1,2,2-trifluoroethane, 6.5% methanol, 0.03% methyl acetate and 0.06% nitromethane.

The treated boards were all found to be perfectly clean.

COMPARISON

By way of comparison the procedure of Example 3 was repeated but using the azeotropic mixture of 1,1,2-trichloro-1,2,2trifluoroethane (87.5%) and methyl acetate (12.5%) as cleaning and rinse mixtures.

After treatment the boards were still found to have flux adhering to them.

We claim:

1. A cleaning composition consisting essentially of 92 to 95 weight percent of 1,1,2-trichloro-1,2,2-trifluoroethane, 5 to 7 weight percent of methanol and 0.05 to 1 weight percent of methyl acetate.

2. A cleaning composition as claimed in claim 1 consisting essentially of 93.5 weight percent 1,1,2-trichloro-1,2,2-trifluoroethane, 6.3 weight percent methanol and 0.2 weight percent methyl acetate.

3. A cleaning composition as claimed in claim 1 or claim 2 in which there is also incorporated 0.2 to 1 weight percent nitromethane.

4. A cleaning composition as claimed in claim 1 or claim 2 in which there is also incorporated about 0.05 weight percent nitromethane.

5. A cleaning composition as claimed in claim 1 or claim 2 consisting essentially of 93.5 weight percent 1,1,2-trichloro-1,2,2-trifluoroethane, 6.5 weight percent methanol, 0.03 weight percent methyl acetate and 0.06 weight percent nitromethane.

6. A method of cleaning contaminated articles by contacting the contaminated articles with a cleaning composition according to claim 1 or claim 3.

* * * * *